United States Patent [19]

Wilson

[11] 4,394,982

[45] Jul. 26, 1983

[54] LINER PLATE FOR GRINDING MILLS

[75] Inventor: Clive J. Wilson, Scottsdale, Ariz.

[73] Assignee: Midland-Ross Corporation, Cleveland, Ohio

[21] Appl. No.: 249,204

[22] Filed: Mar. 30, 1981

[51] Int. Cl.[3] ..... B02C 17/22

[52] U.S. Cl. ..... 241/183; 241/300

[58] Field of Search ..... 241/182, 183, 284, 299, 241/300

[56] References Cited

U.S. PATENT DOCUMENTS 4,270,705 6/1981 Larsen ..... 241/183

*Primary Examiner*—Mark Rosenbaum

*Attorney, Agent, or Firm*—H. Duane Switzer

[57] ABSTRACT

A liner plate for grinding mills includes a short integral lifter bar section having a bolt receiving hole therethrough for securing the plate to the shell of a grinding mill. A replaceable lifter bar section fits onto the liner plate in alignment with the integral lifter bar section. Aligned bolt receiving holes in the replaceable lifter bar section and the plate receive bolts for securing the liner plate and the replaceable lifter bar section together and to the grinding mill shell. Replacement of the replaceable lifter bar section is possible without releasing the entire plate from the shell of the grinding mill.

15 Claims, 10 Drawing Figures

LINER PLATE FOR GRINDING MILLS

BACKGROUND OF THE INVENTION

This application pertains to the art of grinding mills and, more particularly, to liner plates for grinding mills. The invention is particularly applicable to liner plates for the end walls of grinding mills and will be described with reference thereto. However, it will be appreciated that features of the invention can be used for liner plates located in other areas of a grinding mill.

Grinding mills include a shell having a generally cylindrical central wall and opposite end walls through which central inlet and discharge openings are provided for material processed in the mill. The inside of the shell is lined with replaceable liner plates which line the cylindrical wall and the inlet end walls have raised ribs commonly known as lifter bars for lifting material during rotation of the mill shell for achieving optimum grinding action. The lifter bars wear away as the material being ground slides therealong.

When the lifter bars are cast integral with the liner plates, the entire liner plate must be replaced in order to replace worn lifter bars. Therefore, several different arrangements have been used for providing lifter bars which are separate from the liner plates and can be replaced without replacing the liner plates. However, in known arrangements of this type, common bolts are used for securing the replaceable lifter bars and liner plates to one another and to the mill shell. Removal of the bolts for replacing a separate lifter bar often causes the liner plate to fall away from the shell. For this reason, liner plates of this type have been made relatively small so they can be handled more easily during installation and during replacement of the lifter bars.

It would be desirable to have an arrangement wherein lifter bars could be replaced while leaving the associated liner plate securely fastened to the mill shell.

SUMMARY OF THE INVENTION

The liner plates for the inlet end wall of the mill shell have a very low wear area on the lifter bars adjacent the intersection of the inlet end wall with the cylindrical central wall. This is at least partly due to the fact that the material being ground does not slide along the lifter bar in this area as much as such material slides along the full length of the bar. Thus, it has been found that it is possible to cast a very short integral lifter bar section with a liner plate and to provide a bolt hole in this integral lifter bar section for securing the entire plate to the inlet end wall of the mill shell. A replaceable lifter bar section extends over the remaining length of a liner plate, and additional bolts secure the replaceable lifter bar section and the liner plate to one another and to the shell. Removal of these latter bolts for replacement of the replaceable lifter bar section still leaves the liner plate securely held in position with the bolt extending through the integral lifter bar section.

In the preferred arrangement, the liner plate and replaceable lifter bar section have cooperating surfaces shaped to provide a tongue and groove joint which resists lateral movement between the replaceable lifter bar section and the liner plate so that the lateral forces are not taken entirely by the bolts. A similar joint is provided between one end of the replaceable lifter bar section and an upstanding surface on the integral lifter bar section.

It is a principal object of the present invention to provide an improved grinding mill liner plate having a replaceable lifter bar section.

It is also an object of the invention to provide an improved replaceable lifter bar section for grinding mill liner plates.

It is a further object of the invention to provide an improved grinding mill liner plate which can be secured to a mill shell in such a manner that the plate remains securely fastened to the shell while a replaceable lifter bar section is replaced.

DESCRIPTION OF A PREFERRED EMBODIMENT

Figure 1:
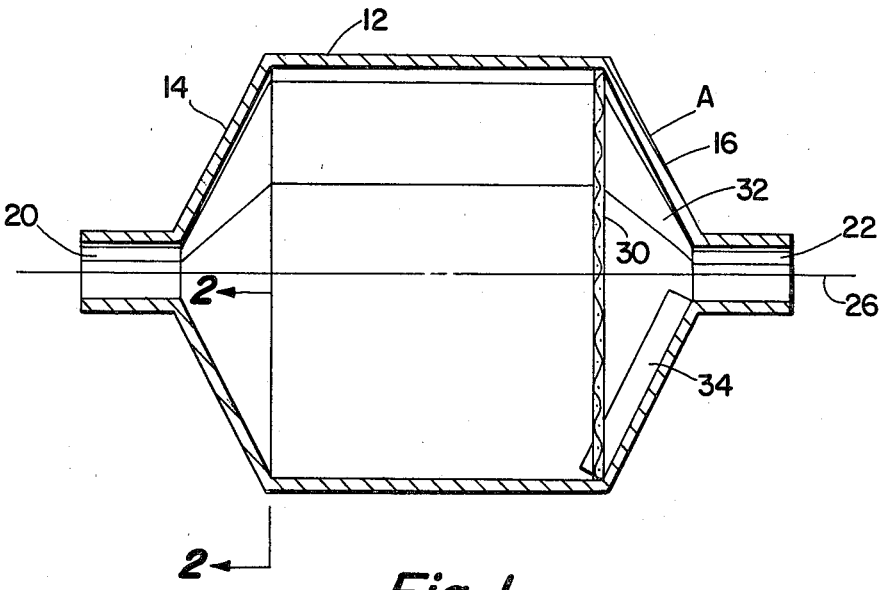
FIG. 1 is a diagrammatic side cross-sectional elevational view of a grinding mill.

With reference to the drawing, FIG. 1 shows a grinding mill shell A having a generally cylindrical central wall 12, and generally conical opposite end walls 14, 16. Central cylindrical inlet and discharge openings 20, 22 are respectively provided in shell end walls 14, 16. The grinding mill is normally positioned with its longitudinal rotational axis 26 downwardly inclined slightly in a direction from inlet opening 20 toward discharge opening 22 so that material will flow through the mill during rotation thereof.

The interior of grinding mill shell A is lined with liner plates in a known manner. The liner plates are removably mounted within the shell so they can be replaced as they wear out during use of the mill. The liner plates are normally of special construction and include such features as lifter ribs or bars for enhancing the grinding action of the mill. Material ground in the mill passes over and through a grate member 30 into a discharge end space 32 having at least one lifting vane 34 therein for lifting material from the bottom portion of discharge space 32 during rotation of the mill and causing same to flow through discharge opening 22.

The internal liner plates for inlet end wall 14 commonly have generally radially extending lifter bars thereon for lifting the material being ground during rotation of the mill. As the material slides along and over these lifter bars, the bars become worn and require replacement. In previous arrangements, the liner plates and lifter bars have been constructed and secured to the shell in such a manner that removal of the bolts for replacement of the lifter bars also releases the liner plates from the shell. It has been found that the portion of a lifter bar located adjacent the intersection of central wall 12 and inlet end wall 14 is subjected to very low wear. Therefore, it has been found that it is possible to construct the liner plates for inlet end wall 14 with an integral lifter bar section located adjacent the intersection of central wall 12 with inlet end wall 14. This integral lifter bar section receives a securing bolt for holding the entire liner plate in position while the remaining of the lifter bar is in the form of a removable lifter bar section which can be replaced without releasing its liner plate from the shell. Therefore, the liner plates can also be constructed to extend from the inlet opening 20 to the intersection of central wall 12 with inlet end wall 14.

Figure 2:
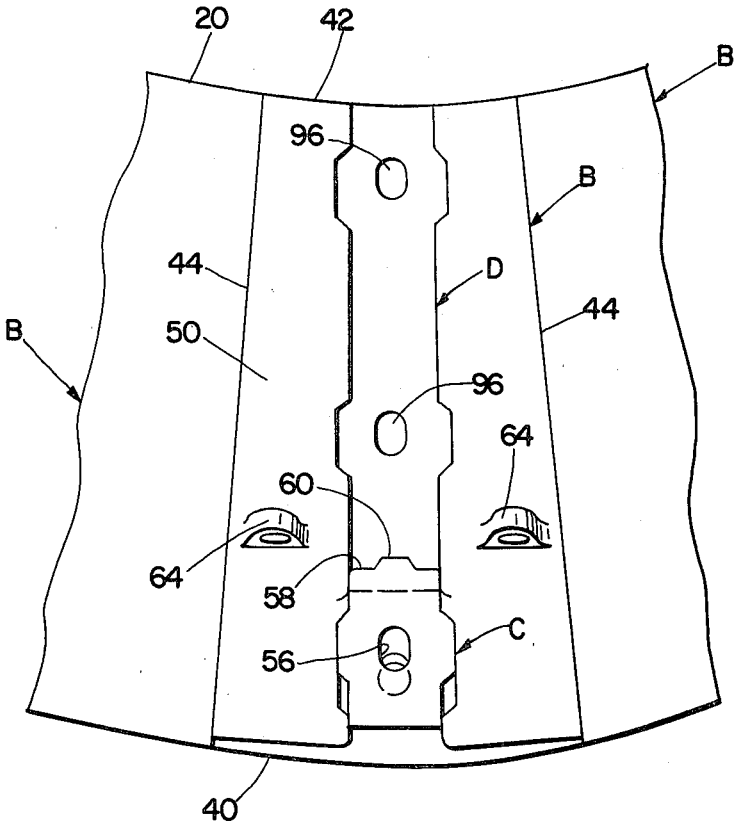
FIG. 2 is a partial cross-sectional elevational view taken generally on line 2—2 of FIG. 1.
Figure 3:
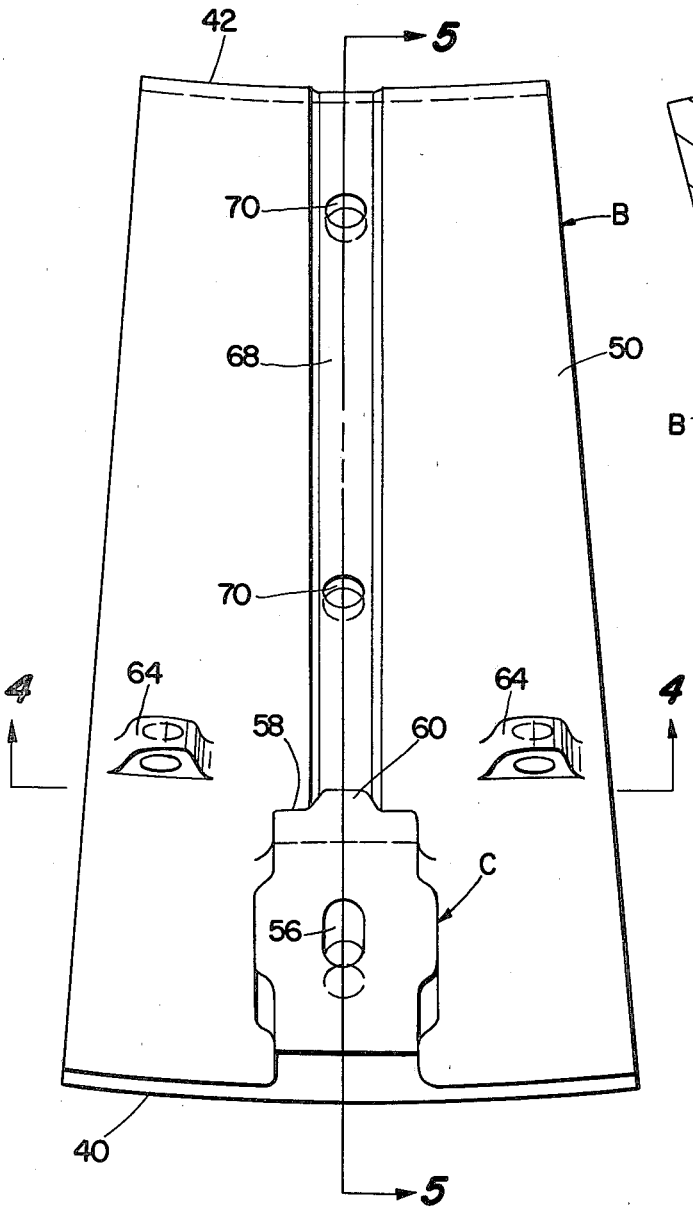
FIG. 3 is a view similar to FIG. 2 and showing a liner plate with a replaceable lifter bar section removed therefrom.
Figure 4:
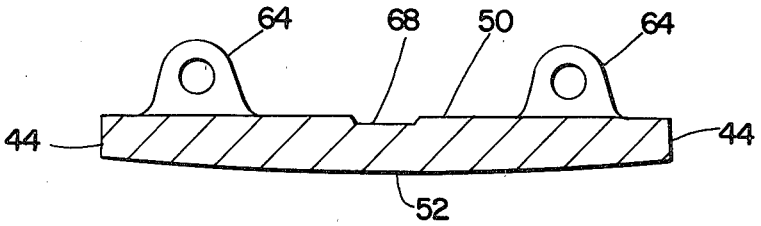
FIG. 4 is a cross-sectional elevational view taken generally on line 4—4 of FIG. 3.

FIG. 2 shows a liner plate B which may be considered to have the general shape of an equilateral trapezoid with long and short opposite ends 40, 42, and opposite sides 44. Opposite ends 40, 42 are curved to generally correspond with the curvature of inlet opening 20 and with the shell at the intersection of central wall 12 with inlet end wall 14. A plurality of the liner plates B are positionable side-by-side to completely line the interior of inlet end wall 14. Liner plate B has opposite front and rear surfaces 50, 52 as best shown in FIG. 4. Rear surface 52 is outwardly curved between opposite sides 44 to lie generally on the surface of a cone corresponding to the internal conical surface of inlet end wall 14.

Figure 5:
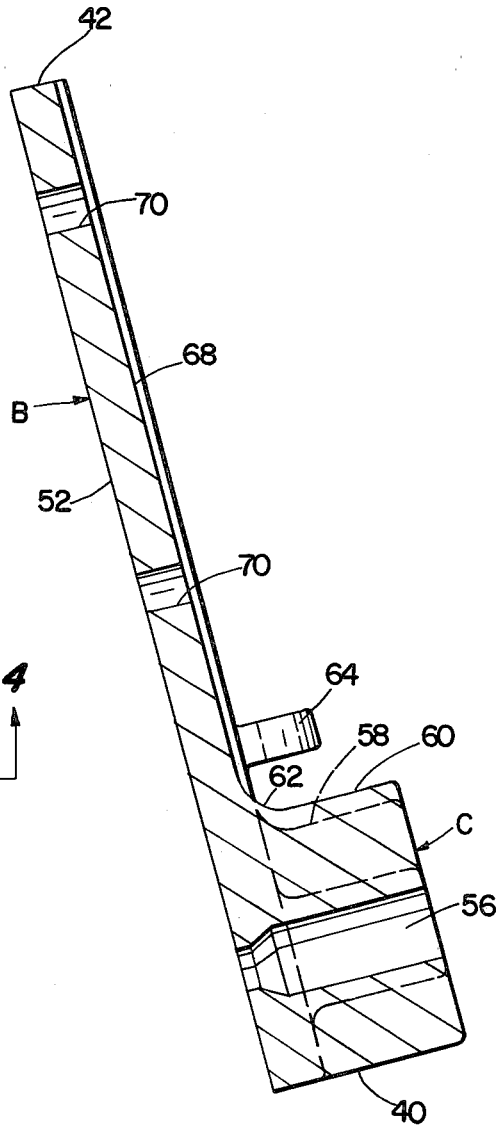
FIG. 5 is a cross-sectional elevational view taken generally on line 5—5 of FIG. 4.

An integral lifter bar section C is cast integral with liner plate B adjacent long end 40 thereof. Integral lifter bar section C has a length which is approximately one-fourth the length of plate B between long and short ends 40, 42 thereof. Integral lifter bar section C has a width adjacent its opposite ends which is less than the width thereof intermediate its ends. Thus, the opposite sides of integral lifter bar section C are undulating. The mean width of integral lifter bar section C is approximately one-fourth the length of long end 40. Integral lifter bar section C is approximately centered on the centerline of plate B between opposite sides 44. A substantially central bolt receiving hole 56 extends through integral lifter bar section C substantially perpendicular to plate B. Integral lifter bar section C has an upstanding surface 58 extending substantially perpendicular to plate B and facing toward short plate end 42. Upstanding surface 58 is shaped to provide a central tongue 60 projecting outwardly therefrom toward short plate end 42. As shown in FIG. 5, tongue 60 and upstanding surface 58 intersect front surface 50 of plate B at a smoothly curved radius generally indicated at 62. Integral lifting lugs 64 extend upwardly from front surface 50 of plate B and holes are provided therethrough for receiving hooks in a known manner.

Plate B has an elongated groove 68 in front surface 50 thereof extending from integral lifter bar section C to plate short end 42. Circular bolt receiving holes 70 are longitudinally spaced along groove 68.

Figure 6:
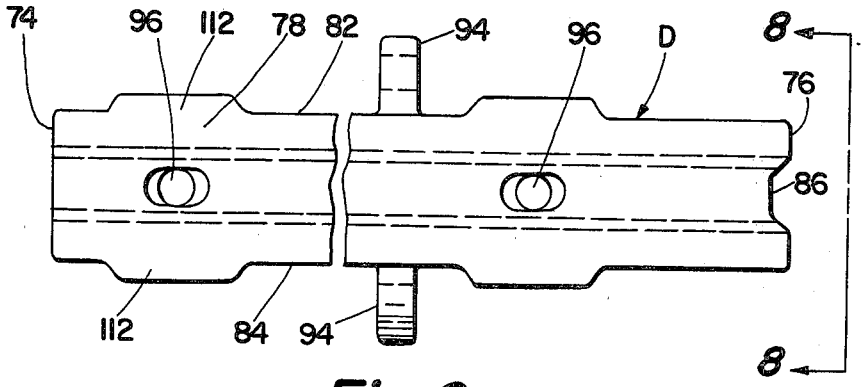
FIG. 6 is a top plan view of a replaceable lifter bar section.
Figure 7:
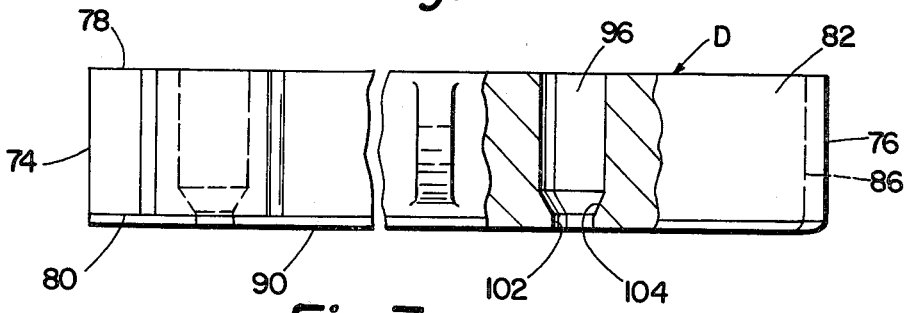
FIG. 7 is a side elevational view of the lifter bar of FIG. 6.
Figure 8:
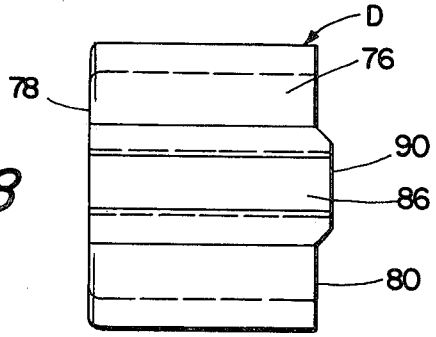
FIG. 8 is an end elevational view taken generally on line 8—8 of FIG. 6.
Figure 9:
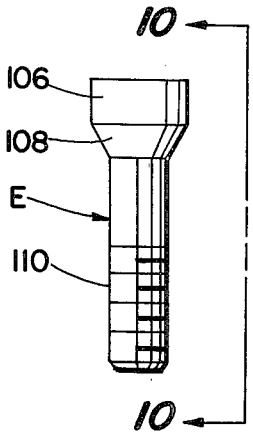
FIG. 9 is an elevational view of a typical bolt used with the liner plate and replaceable lifter bar of FIGS. 1-8.
Figure 10:
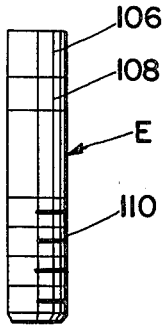
FIG. 10 is an end elevational view taken generally on line 10—10 of FIG. 9.

FIGS. 6–8 show a replaceable lifter bar section D having opposite ends 74, 76, top and bottom surfaces 78, 80 and opposite sides 82, 84. The length of replaceable lifter bar section D between opposite ends 74, 76 thereof is substantially the same as the distance from short plate end 42 to upstanding surface 58 on integral lifter bar section C. End 76 of replaceable lifter bar section D is shaped to provide a vertical groove 86 thereon for closely receiving tongue 60 on integral lifter bar section C. A central tongue 90 projects downwardly from bottom surface 80 and is dimensioned for close reception in groove 68 of plate B. The intersections between bottom surface 80 and end 76, and between tongue 90 and groove 86 are smoothly curved to correspond with curvature 62 in FIG. 5. The width of replaceable lifter bar section D is substantially the same as the width of integral lifter bar section C. Integral lifting lugs 94 having holes therethrough are provided on the opposite sides of replaceable lifter bar section D. Longitudinally-spaced bolt receiving holes 96 extend through replaceable lifter bar section D and are aligned with bolt receiving holes 70 in plate B when lifter bar section D is positioned on plate B with tongue 60 received in groove 86. As clearly shown in FIGS. 6 and 7, holes 90 have upper portions of generally oval cross-sectional shape merging into cylindrical hole portions 102 along an inwardly inclined surface 104. Hole 56 in integral lifter bar section C is correspondingly shaped. This type of hole is known per se in liner plates and lifter bars, and receives a bolt indicated at E in FIGS. 9 and 10 having an oval upper head 106 corresponding to the cross-sectional shape of the oval upper portion of the bolt receiving holes. Oval head 106 merges along an inclined surface 108 into a cylindrical bolt shank 110 which extends through the cylindrical portion of the bolt receiving holes and also extends through suitable holes in mill shell A for receiving nuts. Bolt heads 106 are relatively short in length so that the bolt heads are recessed well below the outer surfaces of the integral or replaceable lifter bar sections. As the lifter bar sections wear away, the integrity of the fastening is maintained because the bolt heads are recessed well below the outer surfaces of the lifter bar sections.

Replaceable lifter bar section D has projections 112 extending outwardly from sides 82, 84 in alignment with bolt receiving holes 96. This arangement provides opposite sides 84, 84 with an undulating shape for enhancing grinding action.

With the construction shown and described, it will be recognized that the bolt extending through bolt receiving hole 56 in integral lifter bar section C will hold entire plate B within mill shell A. Therefore, the bolts extending through holes 96 in replaceable lifter bar section D and through holes 70 in plate B can be removed for replacing lifter bar section D without releasing plate B from the mill shell.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A liner plate for grinding mills comprising: a generally transparent shaped plate having front and rear surfaces, opposite sides, and short and long ends, an integral lifter bar section upstanding from said front face adjacent said long end thereof and spaced inwardly from said sides, said integral lifter bar section extending over substantially less than one-half the length of said plate between said ends thereof, at least one bolt receiving hole extending through said integral lifter bar section substantially perpendicular to said plate, and cooperating means on said plate between said integral lifter bar section and said short end for securing a replaceable lifter bar section thereto.

2. The liner plate of claim 1 wherein said integral lifter bar section has an upstanding surface facing toward said short end and including interfitting means for interfitting with like means on a replaceable lifter bar section.

3. The liner plate of claim 1 wherein said cooperating means includes an elongated groove in said front face of said plate for receiving an elongated projection on a replaceable liner section.

4. The liner plate of claim 3 wherein said cooperating means further includes a plurality of longitudinally-spaced bolt receiving holes through said plate in said groove.

5. The liner plate of claim 1 wherein said integral lifter bar section has an upstanding surface facing toward said short end and intersecting said front face of said plate at a smoothly curved radius.

6. The liner plate of claim 1 including a replaceable lifter bar section positioned against said front face of said plate between said integral lifter bar section and said short end in cooperating relationship with said cooperating means on said plate.

7. The liner plate of claim 6 wherein said cooperating means includes a plurality of longitudinally-spaced bolt receiving holes extending through said plate substantially perpendicular thereto, and said replaceable lifter bar section having bolt receiving holes therethrough aligned with said holes in said plate.

8. The liner plate of claim 6 wherein said cooperating means includes a cooperating tongue and groove joint between said plate and replaceable lifter bar section.

9. A liner plate for grinding mills comprising: a plate having opposite front and rear faces, opposite sides and opposite ends, an integral lifter bar section upstanding from said front face adjacent one of said ends and spaced inwardly from said sides, said integral lifter bar section including at least one bolt receiving hole extending through said integral lifter bar section substantially perpendicular to said plate, an upstanding surface facing toward the other of said ends, and said front face and said upstanding surface being shaped for providing tongue and groove joints with mating surfaces on a replaceable bar section such that the liner plate is adapted to be mounted in a grinding mill with the integral lifter bar section disposed in an area of lesser wear and receive the replaceable lifter bar section in an area of greater wear.

10. The liner plate of claim 9 wherein said front face of said plate has a groove therein extending between said upstanding surface and said other end, and said upstanding surface having a tongue extending therealong from said front face and projecting outwardly toward said other end.

11. The liner plate of claim 9 wherein said integral lifter bar section has an opposite surface generally opposite from said upstanding surface, and said integral lifter bar section having a width in a direction between said plate sides which width is substantially greater intermediate said upstanding and opposite surfaces than adjacent the upstanding surface and adjacent the opposite surface.

12. A replaceable lifter bar section for a grinding mill liner plate having opposite front and rear faces, opposite sides and opposite ends, an integral lifter bar section upstanding from the front face adjacent one of the ends and spaced inwardly from the sides, the integral lifter bar section including at least one bolt receiving holes extending through the integral lifter bar section substantially perpendicular to the plate, an upstanding surface facing toward the other of the ends, and the front face and the upstanding surface being shaped for providing tongue and groove joint portions; said lifter bar section comprising: an elongated bar having top and bottom faces with said bottom face being configured for providing a tongue and groove joint with the liner plate front face, opposite sides and opposite ends with one of said ends being configured for providing a tongue and groove joint with the upstanding surface of the integral lifter bar section, and a plurality of longitudinally-spaced bolt receiving holes through said bar generally perpendicular to said top and bottom faces such that the liner plate is adapted to be mounted in a grinding mill with the integral lifter bar section disposed in an area of lesser wear and receive the replaceable lifter bar section in an area of greater wear.

13. The lifter bar section of claim 12 wherein said bottom face has a tongue therealong and said one end has a groove therein extending between said top and bottom faces.

14. The lifter bar section of claim 12 wherein said opposite sides undulate therealong between said opposite ends.

15. The lifter bar section of claim 12 wherein said one end merges into said bottom face along a smoothly curved radius.

* * * * *